US007363950B2

(12) United States Patent
Wielechowski

(10) Patent No.: US 7,363,950 B2
(45) Date of Patent: Apr. 29, 2008

(54) TILT BASE FOR A ROUTER TOOL

(76) Inventor: Robert E. Wielechowski, 229 Pinery Ct., Henderson, NV (US) 89074

( * ) Notice: Subject to any disclaimer, the term of this patent is extended or adjusted under 35 U.S.C. 154(b) by 0 days.

(21) Appl. No.: 10/935,311

(22) Filed: Sep. 8, 2004

(65) Prior Publication Data

US 2005/0081954 A1 Apr. 21, 2005

Related U.S. Application Data

(60) Provisional application No. 60/511,659, filed on Oct. 17, 2003.

(51) Int. Cl.
*B27C 5/00* (2006.01)

(52) U.S. Cl. ..... 144/136.95; 144/154.5; 409/182

(58) Field of Classification Search ..... 144/48.5, 144/136.95, 154.5; 409/180–182; 408/110–112
See application file for complete search history.

(56) References Cited

U.S. PATENT DOCUMENTS

| | | | | |
|---|---|---|---|---|
| 2,630,151 A | | 3/1953 | Turnbull | |
| 2,630,152 A | * | 3/1953 | Turnbull | 144/136.95 |
| 3,212,541 A | * | 10/1965 | Burrows et al. | 144/134.1 |
| 4,082,474 A | * | 4/1978 | Stiger | 408/110 |
| 4,290,464 A | * | 9/1981 | Marsan | 144/136.95 |
| 4,572,715 A | * | 2/1986 | Wolff | 409/180 |
| 4,655,653 A | * | 4/1987 | Hall et al. | 409/182 |
| 4,827,996 A | | 5/1989 | Cotton et al. | |
| 4,919,176 A | | 4/1990 | Gachet et al. | |
| 5,062,460 A | * | 11/1991 | DeLine | 144/136.95 |
| 5,396,937 A | | 3/1995 | Clausen | |
| 5,611,378 A | | 3/1997 | Brazell | |
| 5,725,038 A | | 3/1998 | Tucker et al. | |
| 5,772,368 A | | 6/1998 | Posh | |
| 6,138,372 A | | 10/2000 | Newman | |
| 6,223,794 B1 | | 5/2001 | Jones | |
| 6,261,036 B1 | * | 7/2001 | Bosten et al. | 409/182 |
| 6,726,414 B2 | * | 4/2004 | Pientka et al. | 409/182 |

FOREIGN PATENT DOCUMENTS

| | | | |
|---|---|---|---|
| GB | EP100421 A2 | * | 2/1984 |
| GB | 2375075 | | 6/2002 |

OTHER PUBLICATIONS

Printout From Porter-Cable Website, Sep. 26, 2003, Description of Porter-Cable Model No. PO-690 Router, Housing & Base.

* cited by examiner

*Primary Examiner*—Shelley M. Self
(74) *Attorney, Agent, or Firm*—Richard C. Litman

(57) ABSTRACT

The tilt base for a handheld router tool allows a router secured therein to be tilted equally in opposite directions from a position in which the rotational axis is normal to the underlying base plate and workpiece. The tilt base includes two opposed tilt clearance areas formed in the lower skirt portion thereof, with two depending opposed pivot attachment lugs or ears separating the two tilt clearance areas. A base plate includes a pair of opposed upstanding pivot attachment fittings, to which the pivot attachment lugs of the router base attach. The base plate may be formed of opaque, translucent, or transparent material, and includes an elongate slot for cutting bit clearance when the router is tilted. The operator of the tool may quickly and easily adjust the tilt angle of the router and its base to provide angled or beveled cuts in a workpiece as desired.

14 Claims, 3 Drawing Sheets

TILT BASE FOR A ROUTER TOOL

CROSS-REFERENCE TO RELATED APPLICATION

This application claims the benefit of U.S. Provisional Patent Application Ser. No. 60/511,659, filed Oct. 17, 2003.

BACKGROUND OF THE INVENTION

1. Field of the Invention

The present invention relates generally to attachments and fixtures for handheld power tools, and more particularly to a base for a router type power tool which provides support for the router while working atop a planar workpiece. The present tilt base has a flat, planar base plate with a router base attached thereto by means of a pair of opposed lateral pivots, allowing the router secured within the base to be adjustably tilted to angle the cutting bit and its resultant cut as desired.

2. Description of the Related Art

The router is a well known type of power tool, and is useful for cutting grooves, slots, mating joints, and other specialized shapes in wood, plastics, and other materials. There are numerous different variations on the handheld router, made by a number of different manufacturers. However, they all essentially comprise an electric (or perhaps pneumatic) motor in a case or housing, with the housing having a base extending from one end thereof. An output shaft or mandrel extends from the base end of the device, and provides for removable attachment of any one of a number of differently configured cutting bits thereon. Such a router is generally manipulated by hand over a workpiece to form the desired cut in the material, with accuracy provided by a guide fence, template, or other aid secured to the work table and/or workpiece.

The above general description of the configuration and use of a router is well known. However, such a relatively simple tool has its limitations. Perhaps the most obvious of these limitations is the fact that the rotational axis of the cutting bit is fixed concentrically relative to the housing and its base. This is fine for many, if not most, operations for which routers are used. However, the operator often wishes to position the cutting bit at an angle other than 90° to the surface of the workpiece. An example of such is when forming a beveled edge on a workpiece. There are a number of router and router table combination tools in which the router is essentially permanently installed beneath the table, with the cutting bit projecting through a hole in the table. Many such devices include various adjustments for the router position relative to the table surface, including tilt for the cutting axis of the tool. However, there are only a relatively few handheld routers which provide any means of holding the cutting axis of the tool at some predetermined angle other than normal to the plane of the base and the surface of the workpiece upon which the base is placed.

The present invention responds to this need by providing a tilt base for a handheld router which allows the angle of the output shaft and cutting blade attached thereto to be adjusted as desired from its standard orientation normal to the workpiece surface, to some other predetermined angle as desired. The present tilt base for a router may be constructed from an existing conventional router base, with the addition of a few components and a base plate upon which the components and router are assembled. The result is a relatively inexpensive tool and attachment which provide versatility only matched by considerably more costly and more cumbersome tools.

A discussion of the related art of which the present inventor is aware, and its differences and distinctions from the present invention, is provided below.

U.S. Pat. No. 2,630,151 issued on Mar. 3, 1953 to Roger F. Turnbull, titled "Portable Track-Guided Tilt Router," describes an assembly in which the router base has a pivot shaft attached thereto by a pair of opposed, laterally offset bosses or lugs. The router housing or case has a lateral flange extending from the lower portion thereof with a pivot shaft attachment boss extending therefrom, through which the router base pivot shaft passes. The router may also be moved linearly along the pivot shaft, as well as being angularly positionable about the axis defined by the pivot shaft. However, the lateral offset of the router mandrel and its cutting bit from the pivot axis results in the cutting bit being raised above the plane of the work when other than normal to the work plane. It is also noted that while Turnbull provides an adjustable lower position stop for the angular movement of his router, he does not provide any means of locking the angle of the router relative to the base. This is because the Turnbull device is configured so the router may be quickly and easily pivoted upwardly from its working position to position the cutting bit precisely over a workpiece therebelow. The Turnbull router assembly does not appear to be designed for to cutting a workpiece at other than 90° to the surface of the workpiece, and the tool does not readily provide for such use.

U.S. Pat. No. 4,827,996 issued on May 9, 1989 to Lawrence M. Cotton et al., titled "Power Tool For Trimming Laminate," describes a router and accessories comprising a number of interchangeable bases which may be secured to the router housing. One of the bases (FIGS. 22 through 24 of the Cotton et al. disclosure) provides for the adjustable tilt of the router when secured therein. While the tilt pivot axis is essentially concentric with the centerline of the router and its cutting axis, the tilt base is asymmetrical. This results in greater angular travel in one direction than in the other, for a router secured therein. In contrast, the present tilt base is symmetrical to each side of the lateral tilt axis, permitting equal arcuate travel in each direction.

U.S. Pat. No. 4,919,176 issued on Apr. 24, 1990 to Benton W. Gachet et al., titled "Ramped device for Finite Positioning Of Panel Joint Forming Tool," describes a router assembly with a base plate having an asymmetrical thickness. This allows the router to cut identically shaped cuts simultaneously in two workpieces staggered in height, thereby allowing the two cuts to mate or mesh with one another when the two workpieces are assembled with their surfaces coplanar with one another. The router base has a tapered base plate surface, with the relative height of one of the workpieces being adjusted by means of a shim having the same angular taper as the base taper angle. However, Gachet et al. do not provide any means of adjusting the angle of the router itself, or of its rotary shaft and cutting bit relative to the base of their device.

U.S. Pat. No. 5,396,937 issued on Mar. 14, 1995 to Allen H. Clausen, titled "Router Table," describes a tilt table for a router which is essentially permanently installed to its base, which is in turn installed beneath the table. The assembly is not portable, as is the present invention. The Clausen router cannot be angularly adjusted relative to its base or to the portion of the overlying table to which it is immovably affixed. The angular adjustment of the Clausen router and table is provided between the leaf or portion of the overlying table to which his router base is attached and the adjacent fixed table structure, not between the router housing and its base plate, as in the present invention.

U.S. Pat. No. 5,611,378 issued on Mar. 18, 1997 to Kenneth M. Brazell, titled "Tilting Router Table," describes another router and table combination in which the router is essentially permanently installed beneath the table with the cutting bit projecting upwardly through. a hole in the table. One side of the table can be tilted normal to the router attachment side to form a fence, if so desired. Also, the entire table and attached router can be tilted 90° to its standard position if desired, with the fence portion horizontal and the opposite table surface portion, with attached router, in a vertical plane. However, none of the adjustments of the Brazell router table permit the router to be tilted at some angle other than 90° to either or both portions of the tabletop, nor does Brazell disclose any provision for a tilt base for a handheld router, as provided by the present invention.

U.S. Pat. No. 5,725,038 issued on Mar. 10, 1998 to Edwin C. Tucker et al., titled "Router Baseplate And Table," describes an assembly which facilitates installation of a router beneath a router table. The router has a plate immovably affixed to the base end of the housing thereof, with the table having an opening therein which substantially matches the router plate. The table opening includes an inwardly projecting flange therearound and below the upper edge thereof, upon which the router plate rests when the plate is placed in the table opening. The flange of the table opening includes a pair of opposed slots therein, through which the edge of the router plate may be guided from below to position the plate above the table while the router remains below the table and attached to the plate. However, once the router and its plate have been installed in the table, the router cannot be tilted relative to the table surface. The Tucker router and table assembly does nothing more than provide for rapid and easy installation and removal of the router and its affixed plate to and from the table. Once the router has been placed in the table, it cannot be tilted or positionally adjusted in any way.

U.S. Pat. No. 5,772,368 issued on Jun. 30, 1998 to Ransom D. Posh, titled "Full-Size Router Tilt Base," describes several embodiments of a handheld router and tilt base assembly. The assembly includes a router mounting collar which is pivotally secured to opposed upstanding lugs or ears which extend from a base plate. However, the Posh assembly differs considerably from the present assembly, in that Posh includes a pair of downwardly extending tilt stop rods attached to the mounting collar. These stop rods extend below the plane of the base plate, and limit use of the Posh router assembly only to edge work. Any attempt to use the Posh router assembly to rout out an angled slot or groove in the central area of a panel or the like, would result in the two angle stop rods interfering with the workpiece panel. Posh also complicates his assembly further by providing a slot and locking knob above the pivot point on each of the upstanding lugs extending from the base plate. Since Posh describes these devices as serving to set and/or limit the angular adjustment of his router assembly, the tilt stop rods appear to be a duplication. In contrast, the present router tilt base is devoid of componentry extending below the base plate, other than the router bit itself. Moreover, the tilt attachment means of the present assembly is considerably more elegant than that of the Posh assembly, requiring only a single bolt on each side. The provision of handles and other features on the router housing base also serves to eliminate complexities in the base structure, where Posh provides attachment holes for handles and other componentry. It is also noted that the Posh router mounting collar or base lacks any form of relatively wide skirt, for greater stability. While the router base of the present invention also lacks such a wide skirt in order to provide the required tilt clearance, the opposite base plate attachment lugs are spaced somewhat more widely than the diameter of the major portion of the router base. This greatly facilitates access to the router cutting bit when changing bits, a better view of the routing operation while underway, and other benefits not provided by the narrow width of the Posh assembly between its opposed pivots.

U.S. Pat. No. 6,138,372 issued on Oct. 31, 2000 to Roger R. Newman, titled "Router Guide Apparatus," describes a relatively complex assembly having a "reference member" or base plate which is pivotally connected to the body component, to which the router is secured. The body component secures to the base plate generally along the centerline of the body component, which results in half of the body component extending below the plane of the workpiece when the body component and router are tilted relative to the base plate. The Newman assembly thus has the same limitations as the tilt assembly of the Posh '368 U.S. patent discussed immediately above, in that the Newman device can only be used along a workpiece edge and cannot be used to rout an angled slot or the like in the general center of the workpiece.

U.S. Pat. No. 6,223,794 issued on May 1, 2001 to James Jones, titled "Woodworking Station," describes an assembly in which the router is secured in a stand resembling a drill press. The rotational axis of the router cutting bit is fixed in the stand. The router can translate linearly upwardly and downwardly in the stand, but cannot be tilted relative to the stand. The only means of angularly adjusting the router relative to the workpiece is by adjusting the tilt of the underlying table beneath the router. The Jones router cannot be held and manipulated by hand when attached to its mounting, as can the present router and tilt assembly.

British Patent Publication No. 2,375,075 published on Nov. 6, 2002 to Denis Whitaker, titled "A Router Tiltably Mounted On A Base," describes a router having an integral mounting housing, with the router permanently installed therein. The mount extends above a pair of parallel columns which provide for linear height adjustment of the router and its cutting bit relative to the underlying workpiece. The bases of the columns, in turn, attach to a pair of pivots which extend upwardly from the base plate, which is placed atop the workpiece. The base plate is asymmetrical, having an offset angular tilt stop to one side of one of the column pivots. The tilt stop of the Whitaker router assembly limits the assembly to tilting in only one direction. The Whitaker device cannot be tilted equally to either side of vertical, as can the present router and tilt base assembly. Moreover, the base plate of the Whitaker router assembly is relatively small for the height of the router, and does not have the elongate configuration, and corresponding stability, of the base plate of the present router and tilt base assembly.

Finally, a printout from the World Wide Web website for the Porter Cable Company includes a web page published at least on Sep. 26, 2003, titled "po690", which describes a Porter-Cable model PO-690 router motor, housing, and base assembly. The present invention makes a modification of the base portion of the above assembly by removing most of the larger diameter skirt area at the output end of the base, thereby providing a tilt clearance area to each side of the device. The portions of the depending skirt of the base immediately below each of the handles are left in place and serve as pivot ears or lugs for attaching the modified device to a base plate, which is placed atop the workpiece during operation. Porter-Cable does not provide such a modification to any of its router tools, nor does it provide any of the additional componentry of the present invention which is required for the tilt operation of the modified router base. It should be noted that the modification to a conventional router base taught by the present invention may be made to the handheld router base of many different models of routers made by different manufacturers. However, the present inventor is not aware of any other manufacturers who provide such a modification to any of their router products.

None of the above inventions and patents, taken either singly or in combination, is seen to describe the instant invention as claimed. Thus a tilt base for a router tool solving the aforementioned problems is desired.

SUMMARY OF THE INVENTION

The present tilt base for a router tool provides a means of adjusting the cutting angle or tilt of a handheld router, with the router and its angularly adjustable base being unattached to an underlying table. The base may be constructed or formed to fit with any of a number of different routers available, or may be modified from an existing router base, as desired.

The router base essentially comprises a sleeve for removably and adjustably securing a router therein. Rather than having a relatively wide cutting bit end skirt completely encircling the cutting bit of the router installed therein, the present router base has two relatively wide, opposed tilt clearance areas formed in the lower portion or skirt thereof. The clearance areas are separated by opposed pivot lugs or ears which depend from the base, and which attach to corresponding lugs or ears extending upwardly from a base attachment ring. The ring is in turn secured to a base plate, which is placed upon the workpiece during operation of the router to position the router and its cutting bit as desired. The opposed clearance areas allow the router base, and router secured therein, to pivot arcuately to either side about the two opposed pivot bolts or pins securing the base to the base attachment ring lugs. The base plate includes a corresponding elongate slot therein to provide clearance for the arcuate movement of the cutting bit, depending upon the tilt adjustment of the router and its base relative to the base plate. The base plate may include a supplementary guide handle, in addition to the conventional guide handles normally provided extending laterally from router bases. A method of modifying an existing router base for use with the base plate and attachment ring of the present invention is also disclosed.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a tilt base for a handheld router tool, enabling the base and the router secured therein to be tilted along a plane which passes through the centerline of the assembly and its output shaft. The term "handheld router tool" as used in the present disclosure, is not intended to indicate that the router itself is held by its outer case or housing when being used, but rather that the router is used with a freely manipulable, handheld base, as opposed to routers which are essentially permanently attached beneath a router table or the like with the cutting bit extending upwardly through an opening in the table. The tilt base of the present invention enables the operator of the device to adjust the angle of the router base relative to the underlying base plate to which it is pivotally attached, thereby allowing the operator to manipulate the router to cut or form beveled edges and other cuts where the cut face is not square with the base of the router and the surface of the workpiece.

Figure 1:
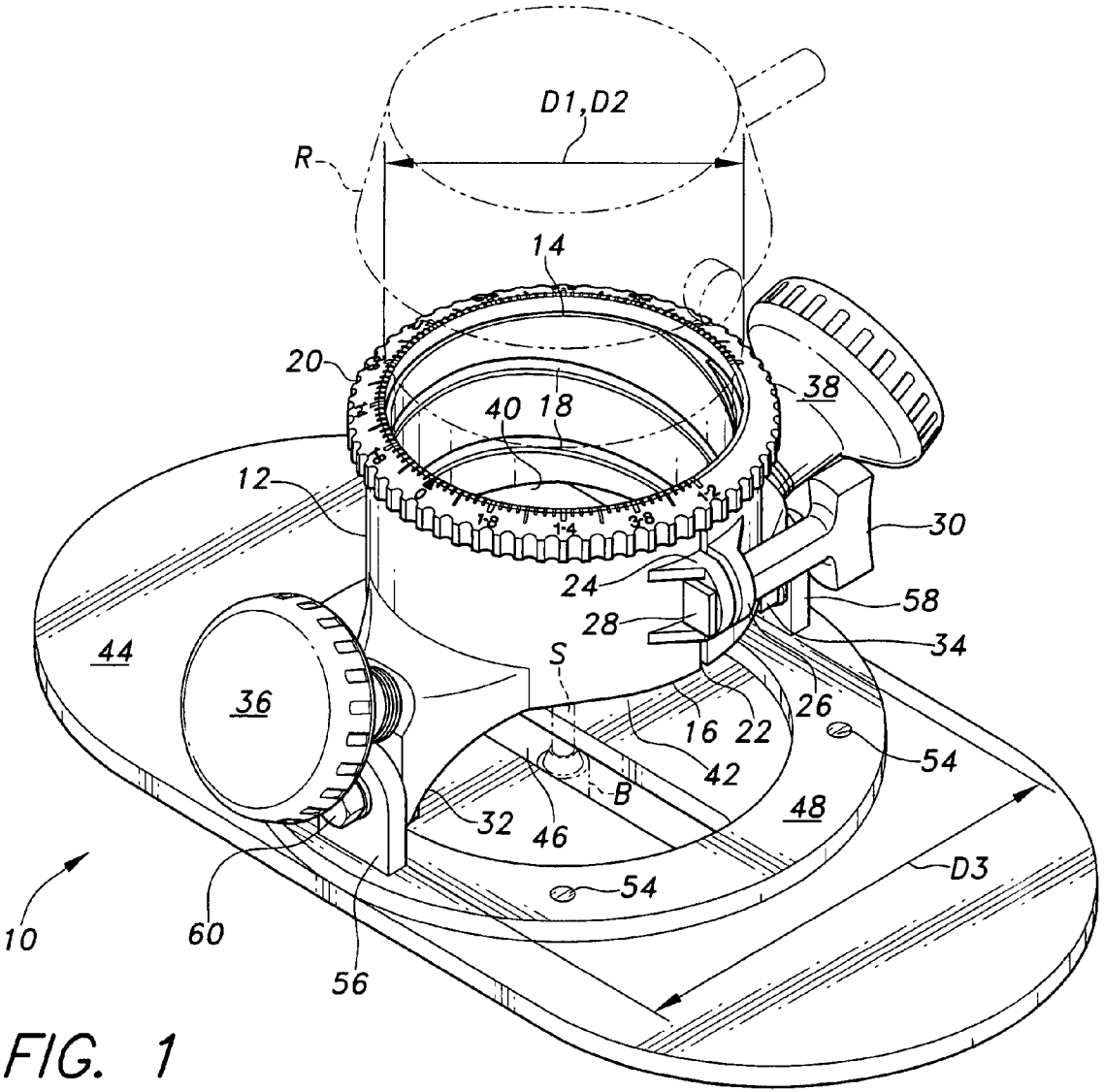
FIG. 1 is a perspective view of a tilt base for a router tool according to the present invention, showing its general configuration and features.

FIG. 1 of the drawings provides a perspective view of the present tilt base assembly 10. The assembly 10 includes a router base 12, in which a handheld router tool R (shown in broken lines in FIG. 1) is removably installed. The base 12 is generally in the form of a cylindrical sleeve and is substantially symmetrical about its central axis, which is concentric with the centerline of the router R, its output shaft S, and interchangeable cutting bit B. The only asymmetric feature of the base 12 is the clamping mechanism (discussed further below) for removably securing the outer housing H (shown in FIG. 2) of the router R within the closely fitting base sleeve 12.

The router base 12 has a router installation end 14 and an opposite base plate attachment end 16, with the router output shaft S or mandrel extending from the base plate attachment end 16 of the router base 12. The internal diameter D1 of the router base sleeve 12 is substantially the same as, or only very slightly larger than, the diameter D2 of the router R, in order to provide a good fit between the two when the router R is installed within the base 12. The router R is installed in the base 12 through the installation end 14, with router height adjustment being accomplished by means of a pin (not shown) which extends radially to engage the helical slot 18 formed within the router base sleeve 12. Rotating the router R within the housing sleeve 12 results in the router R rising or descending relative to the housing 12 as the pin extending from the router R rides along the helical ramp of the slot 18, much like the advance or retreat of a threaded screw. A router height index ring 20 may be provided about the router installation end 14 of the housing 12, if so desired. Other means of adjusting the cutting height of the router R relative to the housing 12 may be provided as desired, e.g. direct axial movement or adjustment of the router R, a rack and pinion gear adjustment, etc.

The router R is locked in place within the base 12 by means of a clamp assembly disposed to one side of the base 12. A slot 22 extends from the router installation end 14 to the opposite base plate attachment end 16 of the router base 12. A clamp bolt lug or ear, respectively 24 and 26, extends outwardly from the base 12 adjacent corresponding sides of the slot 22. A clamp bolt 28 passes through the two lugs 24 and 26, with a winged fastener 30 or other suitable device engaging the threaded end of the bolt 28. The router R is inserted in the router base sleeve 12 and adjusted to the desired cutting height for the router bit B, and the winged fastener 30 is tightened to clamp the base sleeve 12 tightly about the router R to prevent movement of the router R relative to the base 12.

Figure 3:
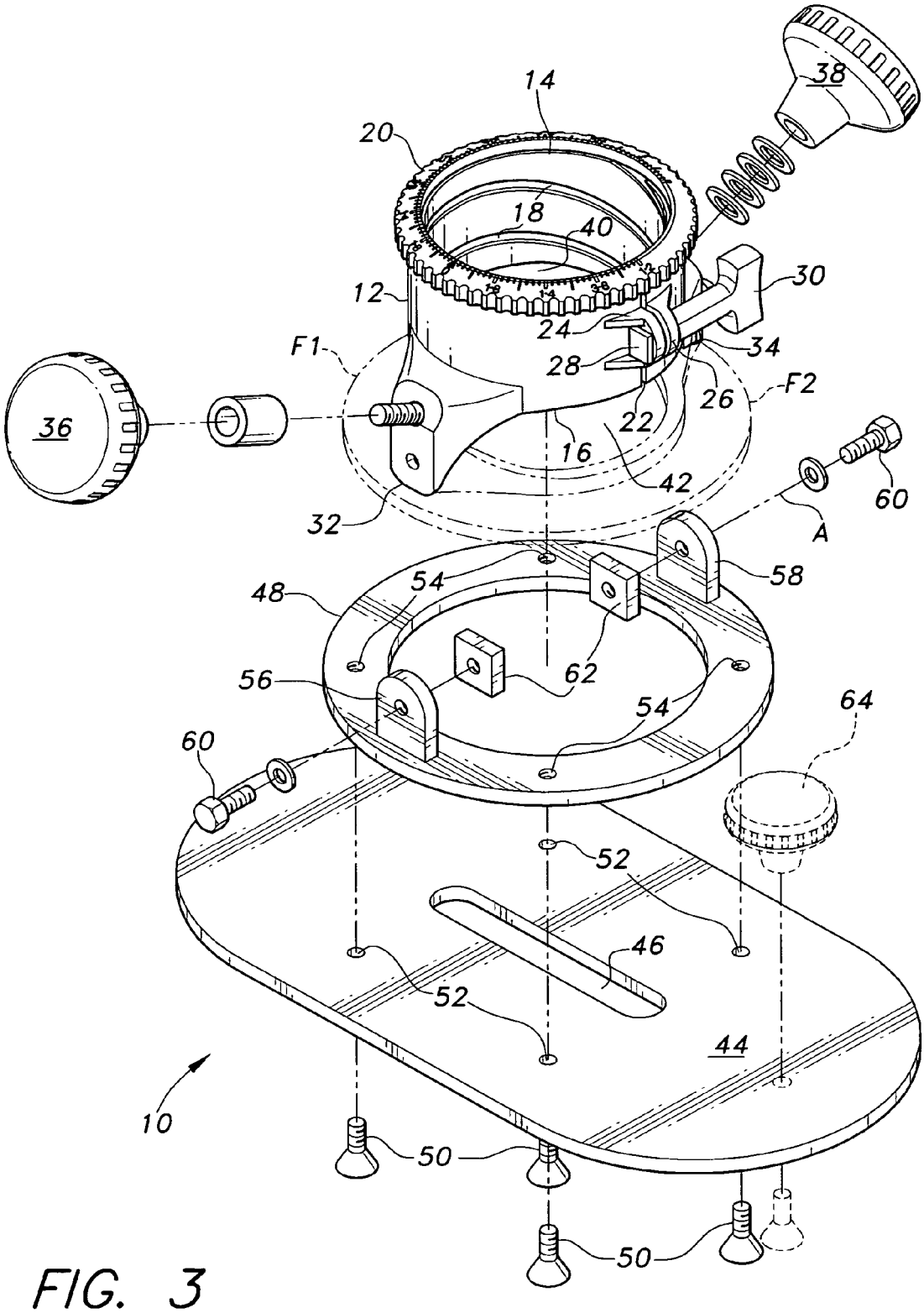
FIG. 3 is an exploded perspective view of the present router tilt base, with the modification to a conventional router base to arrive at the present invention being shown in broken lines.

First and second pivot lugs, respectively 32 and 34, depend from the base plate attachment end 16 of the router base 12, with the two pivot lugs 32 and 34 being disposed laterally opposite one another. The two pivot lugs 32 and 34 depend below the outwardly extending portions of the base 12 which have the two opposed handles 36 and 38 attached thereto and extending therefrom. The handles 36 and 38 may be spaced from the pivot lugs for greater hand clearance for the user by means of one or more washers or a section of pipe or sleeve, as shown in FIG. 3. The outward offset of the two pivot lugs 32 and 34 results in a distance D3-therebetween which is substantially greater than the internal diameter D1 of the router base sleeve 12. This provides much greater clearance for viewing the routing process during the routing operation, and for accessing the cutting bit attachment collet when changing cutting bits.

The conventional router base includes a relatively wide flange or skirt which completely surrounds the output shaft and cutting bit end of the device. While such a surrounding flange or skirt provides the required stability for a router installed within the base, it prevents the base and router installed therein from being tilted; the output shaft and its attached cutting bit are always normal to the workpiece surface upon which the router base rests. Thus, it is impossible to use such a handheld router installed in its base for cutting angled or beveled edges or slots, except by use of a beveled cutting bit, in which case the cutting angle is not adjustable.

The present invention provides a solution to this problem by removing the portions of the surrounding skirt or flange from the lower portion of the base 12, circumferentially between the two depending pivot lugs 32 and 34. This leaves two opposite open tilt clearance areas, respectively 40 and 42, extending circumferentially about the base plate attachment end 16 of the base 12 between the two diametrically opposed pivot lugs 32 and 34. With the tilt clearance areas 40 and 42 providing clearance for the router base 12 to be tilted to either side, the base 12 may be pivotally tilted about the pivot axis A (shown in FIGS. 2 and 3) in order to adjust the cutting angle of the cutting bit B as desired.

The router base 12 is supported concentrically upon a flat, planar, symmetrical base plate 44, which rests atop a workpiece (not shown) during cutting operations by the router R. A router bit clearance passage 46 is provided through the center of the base plate 44, for passage of the router cutting bit B therethrough. It will be noted that the structure of the present invention is devoid of any other components extending below the base plate 44, in order to avoid interfering with the plane of any workpiece upon which the present invention is placed. Thus, the present tilt base 10 and router tool R may be placed anywhere atop a relatively wide expanse of a workpiece to form an angled or normal cut to the surface of the workpiece, without structural interference with the workpiece surface by any other component than the conventional cutting element or bit B of the router R, so that freehand routing, i.e., routing without a fence or guide, is enabled.

As the router R in its base 12 may tilt toward either of the two clearance areas 40 or 42, the router cutting bit B and portion of the shaft S depending below the pivot axis A of the assembly will travel in an arc contained within a plane normal to the pivot axis A. Accordingly, the clearance passage 46 through the base plate 44 is configured as an elongate slot, to provide the necessary clearance for the cutting bit B at each end of its arcuate travel when the router R and its mounting base 12 are pivoted to either extreme position. The base plate 44 is also preferably formed as an elongate sheet as shown in FIGS. 1 and 3, in order to provide greater stability for the assembly.

The base plate 44 may be formed of any of a number of different materials, such as sheet metal (aluminum, steel, etc.), plastics, etc. Many, if not most, operators of the present tool may desire a better view of the underlying workpiece than is available through such opaque materials as metals and the like. Accordingly, the base plate 44 may be formed of a sheet of translucent or transparent plastic material (e.g., acrylic, polycarbonate, etc.) if so desired.

The two depending pivot lugs or ears 32 and 34 of the router base 12 do not attach directly to the base plate 44. Rather, a circular base attachment ring 48 is affixed atop the base plate 44, e.g. by flat head screws 50 installed in countersunk holes 52 formed from the bottom of the base plate 44 (shown generally in FIG. 3). Corresponding threaded holes 54 are provided in the base attachment ring 48. The ring 48 is preferably positioned concentrically about the router bit clearance passage or slot 46, in order to preclude any interference with the edges or ends of the passage or slot 46. The base attachment ring 48 includes diametrically opposed first and second base plate attachment lugs, respectively 56 and 58, affixed thereto (e.g. welded, etc.) and extending normal to the plane of the ring 48. The two attachment lugs 56 and 58 align just outwardly of the corresponding pivot lugs 32 and 34 of the router base 12 and are pivotally connected thereto by pivot bolts 60 and capture nuts 62 (shown in FIG. 3).

Figure 2:
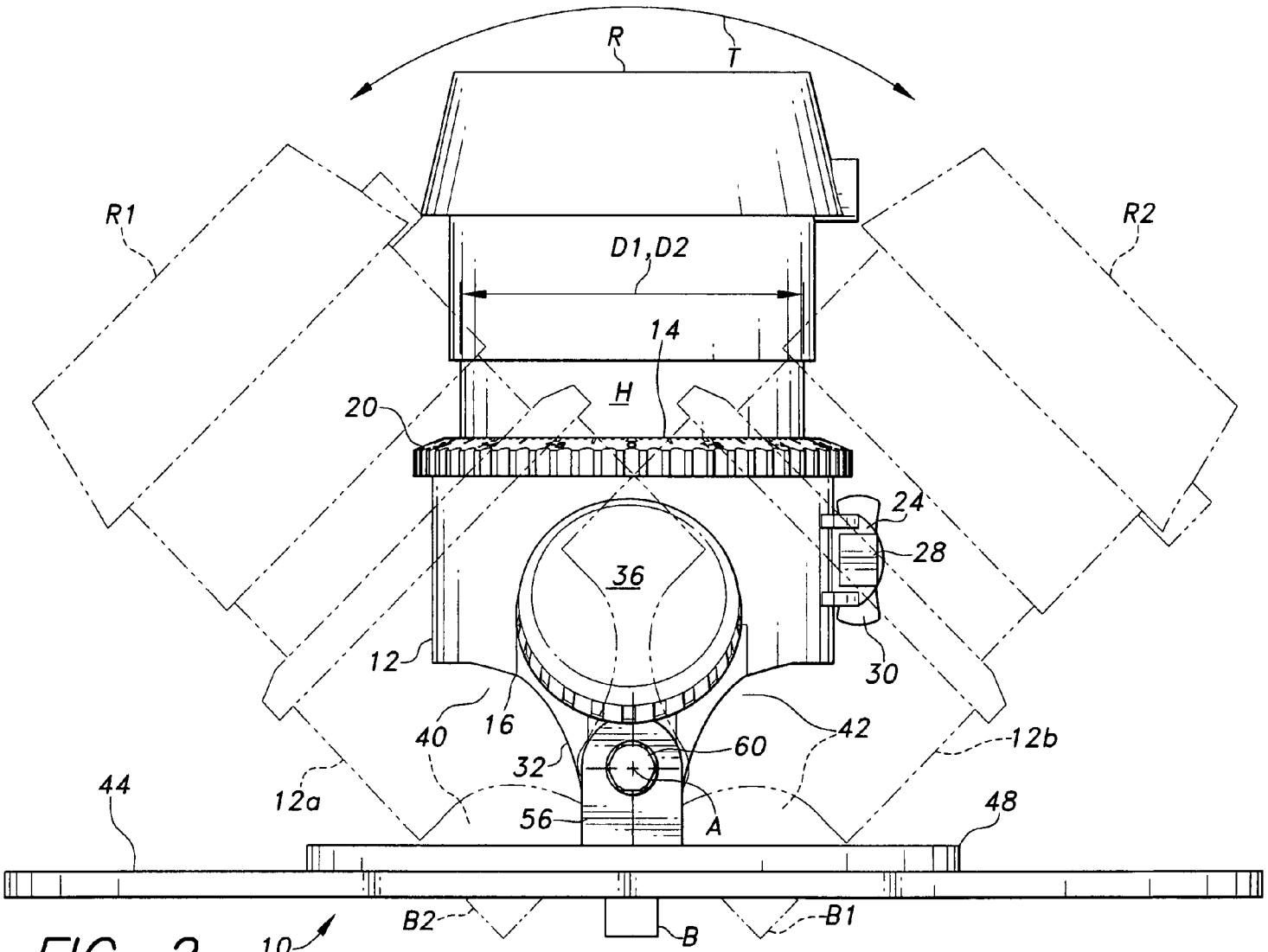
FIG. 2 is a side elevation view of the present router tilt base with a router installed therein, showing alternate tilt positions to each side in broken lines.

The above described assembly allows an operator of the present tool 10 to adjust the angle of the cutting bit B as desired, generally as shown in FIG. 2 of the drawings. The operator need only loosen the two pivot bolts 60 with an appropriate tool (nut driver, socket wrench, etc.) and adjust the angle of the router base 12 and router R contained therein, as desired. The desired angle may be set with a protractor, gauge, or other tool as desired and the two pivot bolts 60 tightened, with the cutting bit B forming a correspondingly angled cut (beveled edge, angled slot, etc.) on or in the workpiece.

The router R and base 12 assembly may be swiveled or pivoted in an arc through its range of travel, as indicated by the arcuate tilt movement arrow T in FIG. 2. In FIG. 2, the assembly is shown tilted to its maximum tilt to the left side of the drawing by the broken line representation of the router R1 and router base 12*a*, with the cutting bit B1 extending downwardly and to the right, through the pivot axis A. The opposite tilt is indicated by the broken line representation of the router R2 and router base 12*b*, with the corresponding cutting bit B2 position extending downwardly and to the left. While a total included tilt angle of approximately 90° is shown between the two extreme positions of the router R1, R2 and router base 12*a*, 12*b*, it will be seen that removal of additional material at the upper edge of the tilt clearance areas will result in even greater tilt angles being possible.

The router base of the present invention may be manufactured by modifying an existing router base. When developing the present invention, the present inventor modified a conventional model 690 router base, manufactured by the Porter-Cable company. The modification comprises cutting away the lower skirt or flange material F1 and F2 (shown in broken lines in FIG. 3), to provide the required tilt clearance areas 40 and 42. The remaining lower material, comprising the handle attach points and depending pivot lugs 32 and 34, is left in place. Any other comparable handheld router base from any other manufacturer may be modified in a similar manner.

Clearly, such a router base configuration is unstable without the relatively wide flange or skirt to rest upon. Accordingly, a stable, but angularly adjustable, base plate and attachment assembly is manufactured to provide for the adjustable attachment of the modified router base 12 thereto. The base plate 44 is formed with means for attaching the router base 12 thereto, by means of up standing base plate attachment lugs 56 and 58. The lugs 56 and 58 are affixed (welded, etc.) diametrically opposite one another to a base attachment ring 48, 24 formed of compatible material (steel, etc.) with the two lugs 56 and 58. The base attachment ring 48 is then mechanically affixed (screws, bolts, etc.) to the underlying base plate 44. This allows the base plate 44 to be formed from a transparent or translucent plastic material, if so desired. Finally, the first and second pivot lugs 32 and 34 of the modified router base 12 are bolted to their respective first and second base attachment lugs 56 and 58 by means of the bolts 60 and captured nuts 62, to pivotally secure the modified router base 12 to the base plate 44. The base plate 44 may include an additional guide handle 64 extending upwardly therefrom, if so desired, as shown in broken lines in FIG. 3, for additional control of the assembly by a person using the device.

In conclusion, the present tilt base for a router tool provides a relatively inexpensive alternative to much more sophisticated and costly router housings and bases previously required to accomplish the same functions as the present invention. Heretofore, it was generally required that a person requiring a router with a tilt function purchase a relatively costly router assembly and router table, and install the router and its base beneath the table in a permanent, or at least semi-permanent, installation. While such a tool provides the required tilt adjustment for forming beveled edges and the like, it lacks versatility due to its lack of portability. Also, most such tools are incapable of forming angled slots in the central area of a workpiece, due to interference by various portions of the router table as they are tilted relative to the router. The present invention provides a solution to these various problems in a handheld assembly which may be used upon a flat, fixed surface to cut a workpiece thereon. The portability and versatility of the present router base will be much appreciated by all craftsmen who have occasion to require the capabilities of the present tool.

It is to be understood that the present invention is not limited to the embodiment described above, but encompasses any and all embodiments within the scope of the following claims.

I claim:

1. A tilt base assembly for a handheld router tool, comprising:

a substantially symmetrical router base, the base including a sleeve having a diameter adapted for removably securing the router tool therein, the sleeve having a router installation end and a base plate attachment end opposite the router installation end;

a first pivot lug extending from the base plate attachment end;

a second pivot lug extending from the base plate attachment end opposite said first pivot lug, each of the pivot lugs being outwardly offset from the sleeve, and defining a distance therebetween substantially greater than the diameter of the sleeve, the pivot lugs further defining first and second open tilt clearance areas circumferentially disposed therebetween, and a tilt pivot axis;

a flat, planar, elongated base plate having a medially disposed router bit clearance passage defined therein, wherein the router bit clearance passage comprises an elongate slot;

a circular base attachment ring depending concentrically from and pivotally secured to the router base by said first and said second pivot lug, said base attachment ring being affixed to said base plate and disposed concentrically about the router bit clearance passage of said base plate;

a first base plate attachment lug and a second base plate attachment lug diametrically opposite said first base plate attachment lug, each said base plate attachment lug extending upward from said base attachment ring; and a pivot bolt disposed through each said base plate attachment lug, pivotally securing a corresponding said pivot lug of said router base thereto;

whereby the router base is selectively tilted relative to the base plate in order to tilt the router tool within the router base as desired, thereby angularly adjusting a cutting bit depending from the router tool through the router bit clearance passage for cutting a workpiece at a predetermined angle.

2. The tilt base assembly according to claim 1, further including a handle extending outwardly from each said pivot lug of said router base.

3. The tilt base assembly according to claim 1, wherein said base plate comprises an elongate sheet of material.

4. The tilt base assembly according to claim 1, wherein said base plate is formed of at least one material selected from the group consisting of opaque, transparent, and translucent sheet material.

5. The tilt base assembly according to claim 1, wherein said router base sleeve has a helical slot formed therein for threadably adjusting the height of the router within said router base.

6. The tilt base assembly according to claim 1, further including a router height index ring disposed atop the router installation end of said router base.

7. The tilt base assembly for a hand held router tool according to claim 1, wherein said router base sleeve has a slot formed therethrough extending from the router installation end to the base plate attachment end thereof, the slot being adapted for receiving a clamping bolt extending across the slot for selectively and immovably clamping the router within said router base sleeve.

8. A tilt base assembly for a handheld router tool and a router tool therewith, comprising in combination:

a router tool having at least:

an outer housing;

an output shaft depending concentrically from said router tool; and an interchangeably attached cutting bit extending from said output shaft;

a substantially symmetrical router base having a sleeve, said router tool being removably secured therein, said router base further having:

a router installation end;

a base plate attachment end opposite said router installation end;

a first pivot lug extending from said base plate attachment end;

a second pivot lug extending from said base plate attachment end, and laterally opposite said first pivot lug;

each said pivot lug being outwardly offset from said sleeve of said router base, and defining a distance therebetween which is substantially greater than said diameter of said sleeve of said router base;

each said pivot lug further defining a first and a second open tilt clearance area circumferentially disposed therebetween, and a tilt pivot axis;

a flat, planar, elongated base plate having a medically disposed router bit clearance passage defined therein, wherein the router bit clearance passage comprises an elongate slot;

a circular base attachment ring depending concentrically from and pivotally secured to the router base by said first and said second pivot lug, said base attachment ring being affixed to said base plate and disposed concentrically about the router bit clearance passage of said base plate;

a first base plate attachment lug and a second base plate attachment lug diametrically opposite said first base plate attachment lug, each said base plate attachment lug extending upward from said base attachment ring; and a pivot bolt disposed through each said base plate attachment lug, pivotally securing a corresponding said pivot lug of said router base thereto;

whereby, said router base is selectively tilted relative to said base plate to tilt said router tool within said router base as desired, thereby angularly adjusting said cutting bit depending from said router tool through said router bit clearance passage correspondingly for cutting a workpiece at a predetermined angle.

9. The tilt base assembly and router tool combination according to claim 8, further including a handle extending outwardly from each said pivot lug of said router base.

10. The tilt base assembly and router tool combination according to claim 8, wherein said base plate comprises an elongate sheet of material.

11. The tilt base assembly and router tool combination according to claim 8, wherein said base plate is formed of a material selected from the group consisting of opaque, transparent, and translucent sheet material.

12. The tilt base assembly and router tool combination according to claim 8, wherein said router base sleeve has a helical slot formed therein for threadably adjusting the height of the router within said router base.

13. The tilt base assembly and router tool combination according to claim 8, further including a router height index ring disposed atop the router installation end of said router base.

14. The tilt base assembly and router tool combination according to claim 8, wherein said router base sleeve has a slot formed therethrough extending from the router installation end to the base plate attachment end thereof, the slot being adapted for receiving a clamping bolt extends across the slot for selectively and immovably clamping the router within said router base sleeve.

* * * * *